US005837035A

United States Patent [19]

Braun et al.

[11] Patent Number: 5,837,035

[45] Date of Patent: Nov. 17, 1998

[54] METHOD AND APPARATUS FOR ELECTROSTATICALLY PRECIPITATING IMPURITIES, SUCH AS SUSPENDED MATTER OR THE LIKE, FROM A GAS FLOW

[75] Inventors: Werner Braun, Wilen-Sarnen; Joseph Gebhart, Dietzenbach; Jerry Rzeznik, Heuchelheim; Gerhard Scheuch, Gemünden; Knut Sommerer, Maintal, all of Germany

[73] Assignee: Maxs AG, Switzerland

[21] Appl. No.: 522,404

[22] PCT Filed: Jan. 10, 1995

[86] PCT No.: PCT/EP95/00073

§ 371 Date: Mar. 8, 1996

§ 102(e) Date: Mar. 8, 1996

[87] PCT Pub. No.: WO95/18680

PCT Pub. Date: Jul. 13, 1995

[30] Foreign Application Priority Data

Jan. 10, 1994 [DE] Germany ..... 44 00 420.6

[51] Int. Cl.[6] ..... B03C 3/45

[52] U.S. Cl. ..... 95/78; 96/68; 96/69; 96/97; 96/98

[58] Field of Search ..... 95/78; 96/63–66, 96/68–70, 97, 98, 100

[56] References Cited

U.S. PATENT DOCUMENTS

| | | | |
|---|---|---|---|
| 832,767 | 10/1906 | Bridge | 96/64 X |
| 1,383,586 | 7/1921 | Wolcott | 96/65 X |
| 1,931,436 | 10/1933 | Deutsch | 96/64 |
| 2,142,128 | 1/1939 | Hoss et al. | 95/79 |
| 2,973,054 | 2/1961 | Kurtz | 96/66 |
| 4,354,858 | 10/1982 | Kumar et al. | 95/78 |

FOREIGN PATENT DOCUMENTS

| | | | |
|---|---|---|---|
| 265451 | 3/1987 | European Pat. Off. . | |
| 506434 | 9/1930 | Germany | 96/98 |
| 1078096 | 3/1960 | Germany | 96/98 |
| 4 223 277 A1 | 1/1994 | Germany . | |
| 746 324 | 3/1956 | United Kingdom . | |
| 1046652 | 10/1966 | United Kingdom | 96/64 |
| 1 267 777 | 3/1972 | United Kingdom . | |

*Primary Examiner*—Richard L. Chiesa

[57] ABSTRACT

The present invention relates to a method and an apparatus for electrostatically precipitating suspended matter from a gas flow, wherein a precipitation electrode which is flown through by the gas flow is provided in the form of a perforated plate behind an ionization source in the direction of flow. The perforated plate has openings which are tapered on their edges in the manner of cutting edges towards the opening.

14 Claims, 1 Drawing Sheet

METHOD AND APPARATUS FOR ELECTROSTATICALLY PRECIPITATING IMPURITIES, SUCH AS SUSPENDED MATTER OR THE LIKE, FROM A GAS FLOW

BACKGROUND OF THE INVENTION

1. Field Of The Invention

The present invention relates to a method and an apparatus for electrostatically precipitating impurities.

2. Description Of The Prior Art

The precipitation of microimpurities from gas flows is of relatively great importance. Lately, a considerable increase in asthmatic diseases could be observed; these are due to impurities, such as carbon or smoke particles. It is possible to precipitate such microimpurities from air with the aid of so-called electrostatic filters. To this end, known filters are, for instance, provided with an ionizing electrode as an ionization source for giving the impurities a negative charge. Precipitation electrodes which are positvely charged are then provided in parallel with one another behind the ionizing electrode in the direction of flow. On account of the opposite charge between the charged impurities and the precipitation electrodes, the impurities, when traveling between the plate-like precipitation electrodes, are deflected to one of the plates to adhere thereto. After a corresponding filtering period has passed, the precipitation electrodes may be flushed or also disposed off. Such an electrostatic filter is, for instance, described in EP-A-265451.

Although such a known electrostatic filter achieves degrees of precipitation that are quite high, it is not suited for use in rooms. On the one hand, the distance covered by the ionized particles through the precipitation electrodes that are arranged in parallel with each other must be chosen such that it is relatively long in order to achieve a high degree of precipitation; on the other hand, a relatively strong electric field is required for achieving adequate precipitation. However, the strong electric field has also the effect that a high electric voltage has to be applied to the ionizing electrodes on the one hand and to the precipitation electrodes on the other hand, which is bound to effect the production of ozone in known electrostatic filters. The production of ozone, however, is especially undesired for the intended use of the electrostatic filters, namely in rooms inhabited by persons suffering from allergies, since ozone affects the respiratory system.

Generic apparatuses are, for instance, known from GB-A-1 267 777, GB-A-746 324 and US-A-2 142 128.

SUMMARY OF THE INVENTION

It is the object of the present invention to improve a method and an apparatus of the above-mentioned type in such a manner that the electrostatic filter is especially suited for use in rooms.

As far as the method is concerned, this object is achieved according to the invention in that the gas flow is guided through openings which are tapered on their edges toward the opening in the manner of cutting edges.

As far as the apparatus is concerned, this object is achieved in that the edges of the openings of the perforated plate are tapered toward their respective opening in the manner of cutting edges.

The gas flow is not guided in parallel with the precipitation electrodes, but in a direction transverse thereto. Large particles directly impinge on the front side (raw gas side) of the perforated plate because of their inertia and because of their electric charge. By contrast, small particles can be entrained along with the gas flow through the openings of the perforated plate and thus pass onto the back side (clean gas side) of the perforated plate. When the gas flow passes through the individual holes of the perforated plate, the charged impurities are exposed to a strong electrostatic field, since the edges of the holes naturally effect a strong curvature of the field lines and thus a high density of the field lines. In addition, the gas flow expands immediately after having passed through the holes, thereby slowing down its speed. This has the effect, together with the intensified electrostatic field, that small impurities are deflected out of the gas flow after having left the openings and are precipitated on the back side of the perforated plate. An advantage which is not to be underestimated is that during operation of the apparatus the openings having a relatively small selected size are not occluded by impurities. Furthermore, the voltage applied to the ionization source, for instance the ionizing electrode, and to the precipitation electrode can be kept so low that the electrostatic fields do not produce ozone.

A strong concentration of field lines and thus great precipitating forces can be enhanced according to the invention in that the edges of the openings of the perforated plate are tapered towards their respective opening.

In an advantageous development of the apparatus, a main dimension of the openings is respectively in the range of from 50 $\mu$m to 500 $\mu$m, preferably 100 $\mu$m and 250 $\mu$m.

Furthermore, it is advantageous when the perforated plate is formed as a perforated straining foil. Since the straining foil is thin, the edges of the holes are correspondingly sharp, resulting in a strong concentration of field lines and thus great precipitating forces. Another advantage of a straining foil filter is its simple cleaning, for instance in a dishwasher, and its reusability.

It is also advantageous when the openings are formed as elongated slots; the slot width should then be between 50 $\mu$m and 500 $\mu$m. An especially advantageous way of making the perforated plate for the present purposes is that the straining foil is made by electrodepositing metals. Sharp-edged hole edges, as is for instance known in the case of shaving foils for electric razers, can be made in especially advantageous manner by electrodeposition of the straining foil. An anti-bacterial effect can be achieved through coating with silver. Moreover, sterilization by heating is also possible.

To obtain a filtering surface which is as large as possible, the perforated plates of the precipitation electrode may be composed in an advantageous manner to have a structure which has the shape of a truncated pyramid and opens towards the source of ionization. The gas flow which is first passed through the source of ionization is thus virtually intercepted in a kind of pocket and can escape through the walls of the pocket.

For the maintenance of the gas flow it is advantageous when a fan is arranged behind the precipitation electrode in the direction of flow of the gas flow.

The ionization source may advantageously consist of a plurality of needle-shaped ionizing electrodes. In a constructional variant the electrodes of the ionization source are negatively charged and the precipitation electrode is positively charged.

A situation in which a plurality of carbon fiber bundles are used as ionization source has been found to be advantageous. The carbon fiber bundles may be arranged in the same manner as the needle-shaped ionizing electrodes. On account of the electric charge, the individual fibers of a carbon fiber bundle repel one another. A high degree of ionization of the particles to be precipitated is achieved.

Furthermore, it is advantageous when a counterelectrode which has the same charge as the ionization source is provided behind the precipitation electrode in the direction of flow. The charged particles which pass through the holes of the precipitation electrode are induced by the field of the counterelectrode to settle on the back side of the precipitation electrode.

It is here especially advantagoeus when the counterelectrode has substantially the same shape as the precipitation electrode, so that there is always the same distance between precipitation electrode and counterelectrode.

To keep the flow resistance of the apparatus very small on the whole, the holes in the counterelectrode may be smaller than those in the precipitation electrode. The size of the holes should be chosen such that a uniform field prevails near the precipitation electrode .

An embodiment of the invention shall now be explained in more detail with reference to a drawing, in which:

DETAILED DESCRIPTION OF THE DRAWINGS

Figure 1:
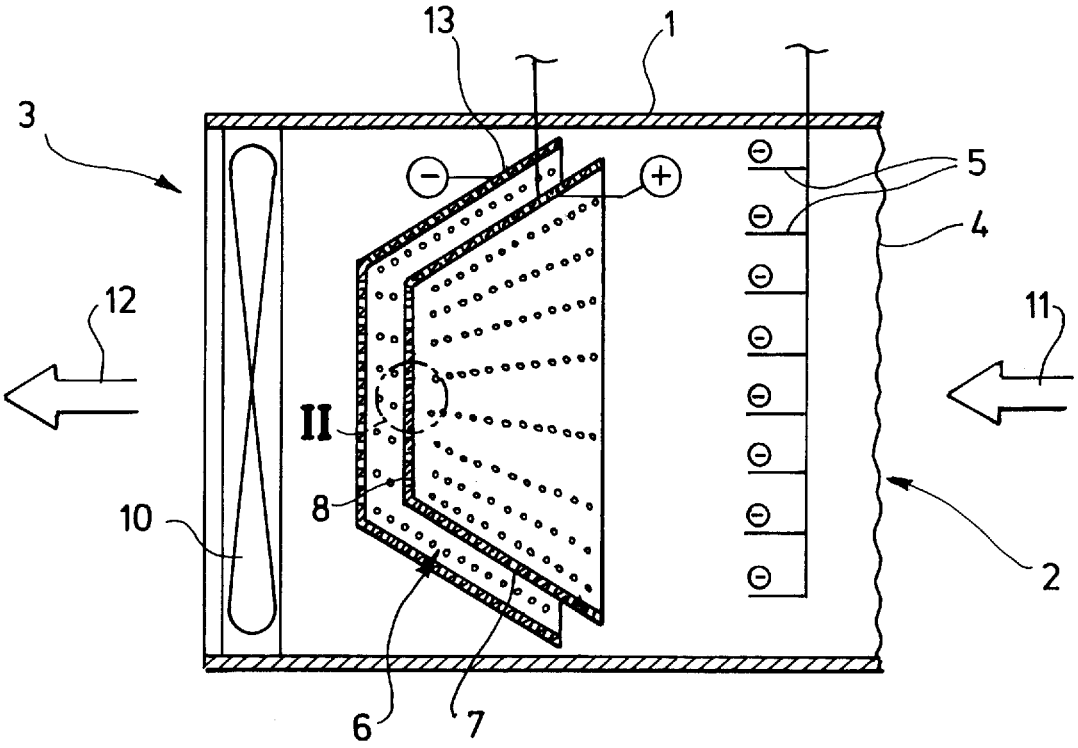
FIG. 1 is a schematic sectional view of an apparatus of the invention.

First of all, the apparatus according to FIG. 1 comprises a housing 1 with a flow inlet 2 and a flow outlet 3. A coarse filter 4, such as a fabric covering, may be provided at the flow inlet. An ionization source which in the present case consists of a plurality of needles 5 is provided behind the flow inlet 2. All of the needles 5 are connected to a negative voltage source of about 4 kV and act as ionizing electrodes in such a manner that the particles in the close vicinity of the needles are negatively charged.

A precipitation electrode 6 in the form of a truncated pyramid that opens towards needles 5 is provided behind needles 5 when seen in the direction of flow. Strictly speaking, the precipitation electrode consists of 4 straining foils that are inclined relative to one another and interconnected on their edges, and of a straining foil 8 which forms the bottom. These straining foils have openings in the form of slots with a slot width b of about 150 $\mu$m.

Figure 2:
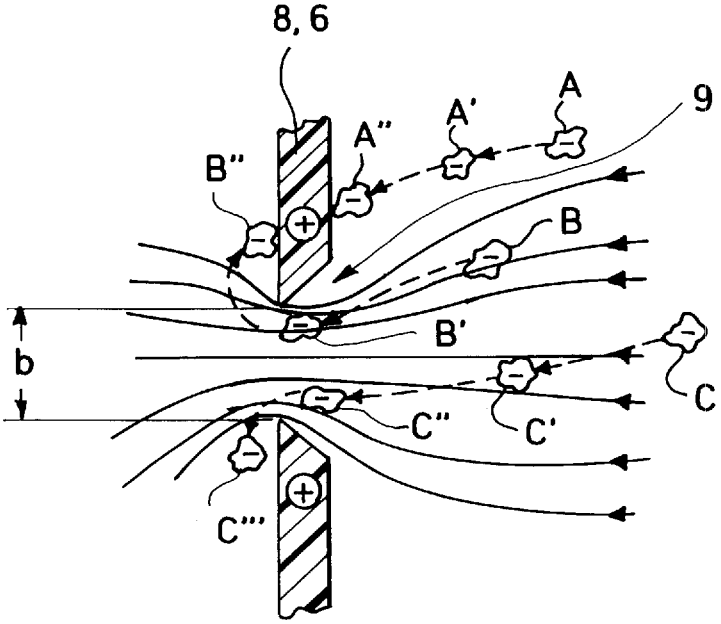
FIG. 2 is an exaggeratedly large magnification of a "hole situation" according to detail view II of FIG. 1.

As is more clearly shown in FIG. 2, the opening edge of slots 9 is tapered in the manner of cutting edges towards the opening. The straining foils are made by electrodepositing metals.

A counterelectrode 13 which is charged in the same manner as the ionization source may be provided behind precipitation electrode 6. The negatively charged impurities which pass through the precipitation electrode are rejected by this additional electrode, whereby the particle precipitation on the back side of the precipitation electrode is intensified.

Furthermore, a fan 10 which ensures maintenance of the gas flow through the housing is provided behind the precipitation electrode 6.

Operation and function of the invention shall now be explained in more detail. First of all, the apparatus sucks a polluted gas flow 11 through flow inlet 2. The individual particles of the polluted gas flow are negatively charged by needles 5 which act as an ionizing electrode. The pollutants or impurities charged in this manner enter into the structure which is shaped as a truncated pyramid and surrounded by straining foils 7 and 8. The gas flow can only enter through the individual slots 9 into the straining foils through the filter. What happens with the individual particles is best illustrated by way of the "hole situation" shown in FIG. 2. The gas flow must pass through a multitude of slots 9. Particles, such as particle A, which are positioned on the edge of such a flow branch impinge onto the front side of the straining foil because of their inertia, especially when they have a large size. This effect is enhanced by the additional electric field. Smaller particles which are positioned further in the center of a partial flow, such as particles B and C, follow the gas flow through slot 9. Since the edges of slots 9 are sharp, particles B and C pass through an extremely strong electric field which already effects a lateral deflection of the particles during passage through the slot. As soon as the partial flow of the gas has passed slot 9, the partial flow expands and gives particles B and C a speed component in parallel with straining foil 8. This speed component is substantially in parallel with the force of attraction by the electric field in the area of the edge of slot 9. This has the effect that particles B and C settle on the back side of the straining foils. This effect is even intensified by the counterelectrode 13 which is arranged at some distance behind the precipitation electrode 6. The flow resistance is only inconsiderably increased because of the holes of the counterelectrode whose size is chosen to be greater, so that the filter exhibits a high cleaning degree. The gas flow 12 which has been cleaned in this manner then exits through fan 10 and leaves housing 12. Astonishingly enough, the electrostatic filter of the invention can have a relatively small size. Moroever, the electrostatic filter can be operated at voltages that are so low that no ozone will be released.

We claim:

1. A method for electrostatically precipitating impurities from a gas flow, said gas flow being first supplied to an ionization source for charging said impurities, whereupon said impurities are attracted on account of their charge by an oppositely poled precipitation electrode and are precipitated thereon, said gas flow being guided substantially entirely through openings of a perforated plate which is used as said precipitation electrode and whose opening dimensions are dimensioned such that at least part of the impurities can penetrate through said openings, wherein said gas flow being guided through said openings which are tapered on their edges forming cutting edges towards said opening.

2. An apparatus for electrostatically precipitating impurities from a gas flow, comprising at least one first electrode as an ionization source for charging said impurities, and at least one second, oppositely poled precipitation electrode for precipitating said ionized impurities from said gas flow, said precipitation electrode comprising as a perforated plate which permits passage of said gas flow and at least part of said impurities and which is arranged in said gas flow such that said gas flow is bound to pass through the openings of said perforated plate entirely, wherein the edges of said openings of said perforated plate being tapered and forming cutting edges towards their respective opening.

3. An apparatus according to claim 2, wherein a main dimension of said openings is in the area between 50 $\mu$m and 500 $\mu$m.

4. An apparatus according to claim 2, wherein said perforated plate is formed as a perforated straining foil.

5. An apparatus according to claim 4, wherein said straining foil is formed by electrodeposited metals.

6. An apparatus according to claim 2, wherein said openings are formed as slots.

7. An apparatus according to claim 2, wherein said perforated plates of said precipitation electrode are comprised of a structure shaped as a truncated pyramid and opening towards said ionization source.

8. An apparatus according to claim 2, wherein a fan is arranged behind said precipitation electrode in the flow direction of said gas flow.

9. An apparatus according to claim 2, wherein said ionization source consists of a plurality of needle-shaped ionizing electrodes.

10. An apparatus according to claim 2, wherein said ionization source consists of a plurality of ionizing electrodes comprising carbon fiber bundles.

11. An apparatus according to claim 2, wherein a counterelectrode which has the same charge as said ionization source is arranged behind said precipitation electrode.

12. An apparatus according to claim 11, wherein said counterelectrode is adapted to the shape of said precipitation electrode and has substantially the same distance thereto in all places.

13. An apparatus according to claim 11, wherein said counterelectrode also comprises a perforated plate, but with holes larger than those of said precipitation electrode.

14. An apparatus according to claim 2, wherein said electrodes of said ionization source are negatively charged and said precipitation electrode is positively charged.

* * * * *